US008668200B2

(12) United States Patent
Iijima et al.

(10) Patent No.: US 8,668,200 B2
(45) Date of Patent: Mar. 11, 2014

(54) CARRYING APPARATUS AND IMAGE RECORDING APPARATUS INCLUDING THE SAME

(75) Inventors: Shota Iijima, Nagoya (JP); Iwane Sano, Nagoya (JP); Yasuhira Ota, Yatomi (JP); Naokazu Tanahashi, Nagoya (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 385 days.

(21) Appl. No.: 13/027,151

(22) Filed: Feb. 14, 2011

(65) Prior Publication Data

US 2011/0222947 A1 Sep. 15, 2011

(30) Foreign Application Priority Data

Mar. 12, 2010 (JP) ..... 2010-056407

(51) Int. Cl.
*B65H 5/02* (2006.01)

(52) U.S. Cl.
USPC ..... 271/272; 271/273

(58) Field of Classification Search
USPC ..... 271/272, 273
See application file for complete search history.

(56) References Cited

U.S. PATENT DOCUMENTS

| | | | | |
|---|---|---|---|---|
| 7,393,097 | B2 * | 7/2008 | Nakashima et al. | 271/273 |
| 7,478,721 | B2 * | 1/2009 | Herd | 198/626.5 |
| 2004/0097310 | A1 | 5/2004 | Koase et al. | |
| 2009/0218761 | A1 | 9/2009 | Sakano | |

FOREIGN PATENT DOCUMENTS

| | | | |
|---|---|---|---|
| JP | 2004-123381 | A | 4/2004 |
| JP | 2006-212797 | A | 8/2006 |
| JP | 2007-136802 | A | 6/2007 |
| JP | 2009-203021 | A | 9/2009 |

* cited by examiner

*Primary Examiner* — Michael McCullough
*Assistant Examiner* — Howard Sanders
(74) *Attorney, Agent, or Firm* — Baker Botts L.L.P.

(57) ABSTRACT

A carrying apparatus includes: a carry path which is defined to guide a first carried object and a second carried object; a first pulley; a first roller; a second pulley; a first belt which is wound on the first pulley and the second pulley; a first tensioner; and a first moving mechanism which moves the first roller between a first position and a second position. The first moving mechanism moves the first roller between a first position at which the first roller carries the first carried object and a second position which is farther from the carry path than the first position and at which the first roller carries the second carried object.

20 Claims, 6 Drawing Sheets

CARRYING APPARATUS AND IMAGE RECORDING APPARATUS INCLUDING THE SAME

CROSS REFERENCE TO RELATED APPLICATION

The present application claims priority from Japanese Patent Application No. 2010-056407, which was filed on Mar. 12, 2010, the disclosure of which is herein incorporated by reference in its entirety.

BACKGROUND OF THE INVENTION

1. Field of the Invention

The present invention relates to a carrying apparatus which carries a carried object by rotation of rollers, and particularly to a carrying apparatus in which respective pulleys provided with the respective rollers are connected by a belt and to an image recording apparatus which includes the carrying apparatus.

2. Discussion of Related Art

There is known a carrying apparatus which carries a carried object by rotation of rollers. For example, such a carrying apparatus is included in an image recording apparatus of an inkjet type or an electrophotographic type which records an image on a sheet-like recording medium such as a recording sheet. More specifically, the image recording apparatus includes a pair of rollers as the carrying apparatus, a carry path which guides the sheet-like recording medium as the carried object, a recording portion which records an image on the recording medium, and so on. In the image recording apparatus, the sheet-like recording medium is fed through the carry path while nipped by the pair of rollers, and a desired image is recorded on the recording medium when the recording medium passes the recording portion. The pair of rollers are held in contact with each other in order to nip and carry the sheet-like recording medium.

There are generally a plurality of pairs of rollers provided in the carry path because the carry path of the image recording apparatus has some degree of length. Further, some image recording apparatus has a structure in which, with at least one of each pair of rollers, there is provided a pulley which rotates integrally with the at least one roller, and a belt is wound on the pulleys. In this image recording apparatus, a drive force is transmitted from one roller to another roller through the belt. Accordingly, the plurality of rollers can be driven by one drive source.

SUMMARY OF THE INVENTION

As the recording medium on which an image is recorded in the above-mentioned image recording apparatus, the recording medium having high rigidity such as a CD and a DVD as well as the sheet-like recording medium having low rigidity such as a recording sheet has been suggested. In general, when an image is recorded on the recording medium having high rigidity, the recording medium is set in a tray for exclusive use. The tray is inserted into an insertion opening formed in the image recording apparatus and carried into inside of the image recording apparatus.

However, the tray has a larger thickness than the recording medium having low rigidity such as the recording sheet. Therefore, in a case where each pair of rollers provided in the carry path are in contact with each other in order to nip the sheet-like recording medium, each pair of rollers cannot nip the recording medium having high rigidity. To solve the above problem, it can be considered that the image recording apparatus which can record an image on the recording medium having high rigidity has a mechanism in which a pair of rollers are moved away from each other, i.e., a mechanism in which at least one of the pair of rollers is movable. For example, when an image is recorded on the recording medium having low rigidity, the pair of rollers are in contact with each other, and when an image is recorded on the recording medium having high rigidity, the pair of rollers are moved away from each other.

However, in a case where a pulley is provided in the movable roller and connected with a pulley provided in another motor by a belt, the following problem occurs. In general, when the belt is wound on the pulleys, a tension is applied to the belt by a tensioner. In this case, the tension applied to the belt changes with the movement of the movable roller.

For example, in a case where the tensioner is disposed outside a circular belt that is wound on two pulleys, so as to be located on a side of the circular belt nearer to the carry path, and a tension is applied to the circular belt by the tensioner from outside the circular belt in a first direction in which the roller is moved, when the roller is moved in the first direction, the tension by the tensioner may be weakened. On the other hand, in a case where the tensioner is disposed outside the circular belt so as to be located on a first-direction side of the circular belt, and the tension is applied to the circular belt by the tensioner from outside the circular belt in a second direction toward the carry path, when the roller is moved in the first direction, the tension by the tensioner may be strengthened.

When the tension applied to the belt changes as mentioned above, a drive force cannot be properly transmitted between the rollers, and capability of carrying of the recording medium may become unstable. Further, when the tension is weakened and the belt goes slack, the belt may slip around (come off) the pulley/pulleys and the tensioner. When the tension is strengthened, it accelerates deterioration of the belt and the belt may be stretched or broken.

It is therefore an object of the present invention to provide a carrying apparatus and an image recording apparatus to, in a case where rollers are connected by a belt with each other, move at least one of the rollers with reducing an excessive change in tension of the belt.

According to the present invention, there is provided a carrying apparatus comprising: a carry path which is defined to guide a first carried object and a second carried object which is larger in thickness than the first carried object; a first pulley which is configured to be rotated by a drive force generated in a drive source; a first roller which is provided on one side of opposite sides of the carry path; a second pulley which is provided coaxially with the first roller and is configured to be rotated integrally with the first roller; a first belt which is wound on the first pulley and the second pulley and is configured to be moved circumferentially between the first pulley and the second pulley; a first tensioner which is fixed at a position where the first tensioner applies a predetermined tension to the first belt; and a first moving mechanism which is configured to move the first roller between (i) a first position at which the first roller carries the first carried object and (ii) a second position which is farther from the carry path than the first position and at which the first roller carries the second carried object. The first moving mechanism which is configured to move the first roller between (i) a first position at which the first roller carries the first carried object and (ii) a second position which is farther from the carry path than the first position and at which the first roller carries the second carried object. The second position is a position at which a tension by the first tensioner to the first belt is substantially equal to the predetermined tension applied by the first tensioner to the first belt where the first roller is positioned at the first position.

In the carrying apparatus, when the first roller is moved from the first position to the second position, the tension applied to the first belt can be substantially equal to that when the first roller is positioned at the first position.

BRIEF DESCRIPTION OF THE DRAWINGS

The above and optional objects, features, and advantages of the present invention will be better understood by reading the following detailed description of the embodiments of the invention when considered in conjunction with the accompanying drawings, in which:

FIG. 5A shows a case where a third feed roller 45 is moved from a third position 143 to a fourth position 144; FIG. 5B shows a case where the third feed roller 45 is moved among the third position 143, the fourth position 144 and a fifth position 145; FIG. 5C shows a case where slopes among the respective positions 143, 144, 145 are constant; and FIG. 5D shows a case where a slope from the third position 143 to the fifth position 145 is gentler than that from the fifth position 145 to the fourth position 144;

DETAILED DESCRIPTION OF THE PREFERRED EMBODIMENTS

Hereinafter, there will be described preferred embodiments of the present invention with reference to the drawings. The present invention is not limited to the embodiments described later. It is to be understood that the present invention may be embodied with various changes and modifications that may occur to a person skilled in the art, without departing from the spirit and scope of the invention defined in the appended claims. Hereinafter, on the basis of a state in which a Multifunction Device (MFD) 10 is installed in use (a state shown in FIG. 1), a vertical direction 7 is defined, a side where an opening 13 is formed is defined as a front side and a front-rear direction 8 is defined, and a left-right direction 9 is defined as seen from the front side of the MFD 10.

[MFD 10]

Figure 1:
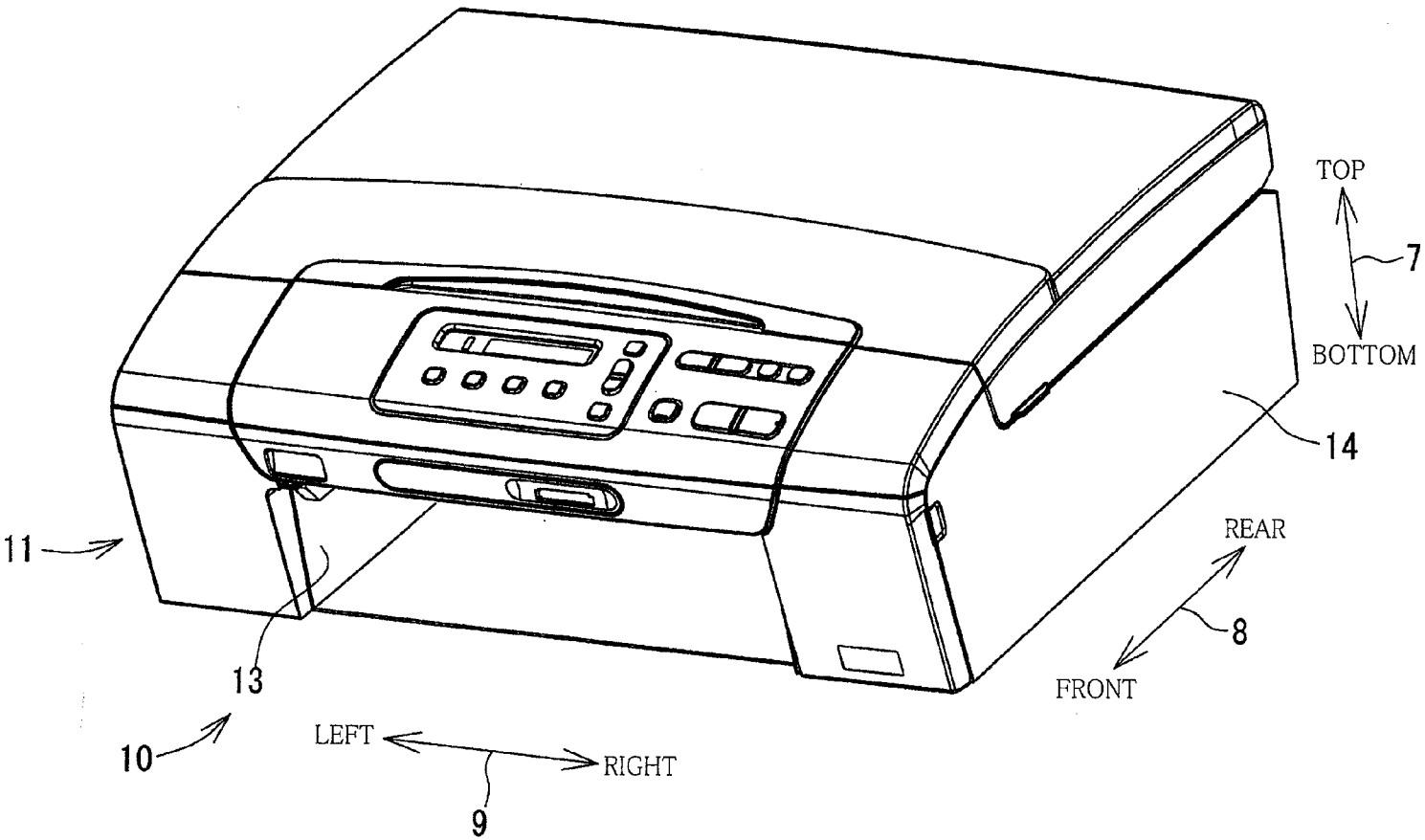
FIG. 1 is a perspective view showing an appearance of a Multifunction Device 10 as an example of embodiments of an image recording apparatus in the present invention.

As shown in FIG. 1, the MFD 10 as an example of an image recording apparatus in the present invention has a substantially flat rectangular parallelepiped shape and has a printer portion 11 of an inkjet recording type in a lower portion thereof. The MFD 10 has various functions such as a facsimile-machine function and a printer function. The printer portion 11 includes a casing 14 that has the opening 13 in the front side thereof. A sheet-supply tray 20 and a sheet-discharge tray 21 (shown in FIG. 2) are insertable into and detachable from the opening 13 in the front-rear direction 8. On the sheet-supply tray 20, a desired size of a recording sheet (as an example of a first carried object in the present invention) can be placed.

Figure 2:
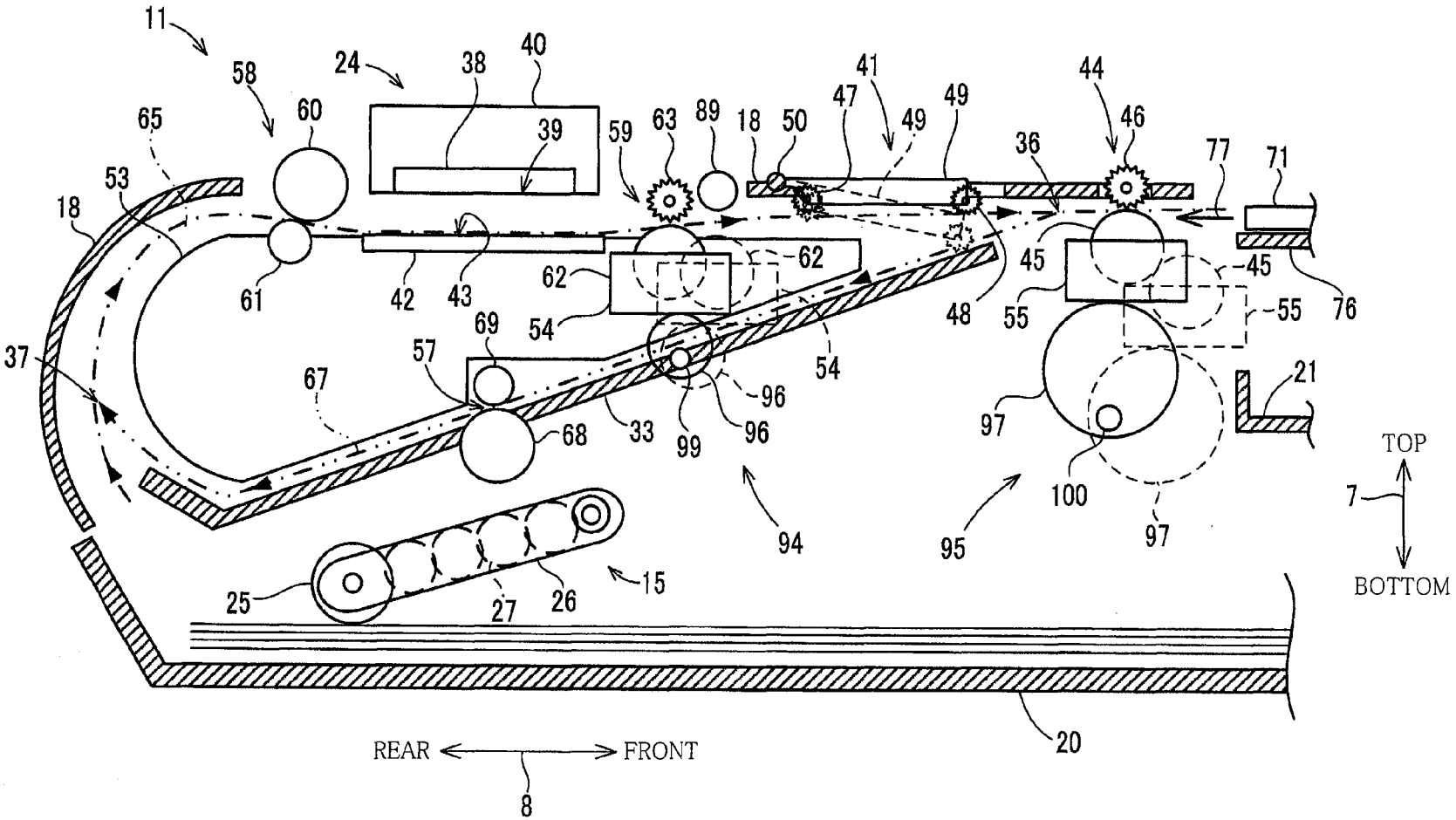
FIG. 2 is a side cross-sectional view schematically showing an internal structure of a printer portion 11.
Figure 3:
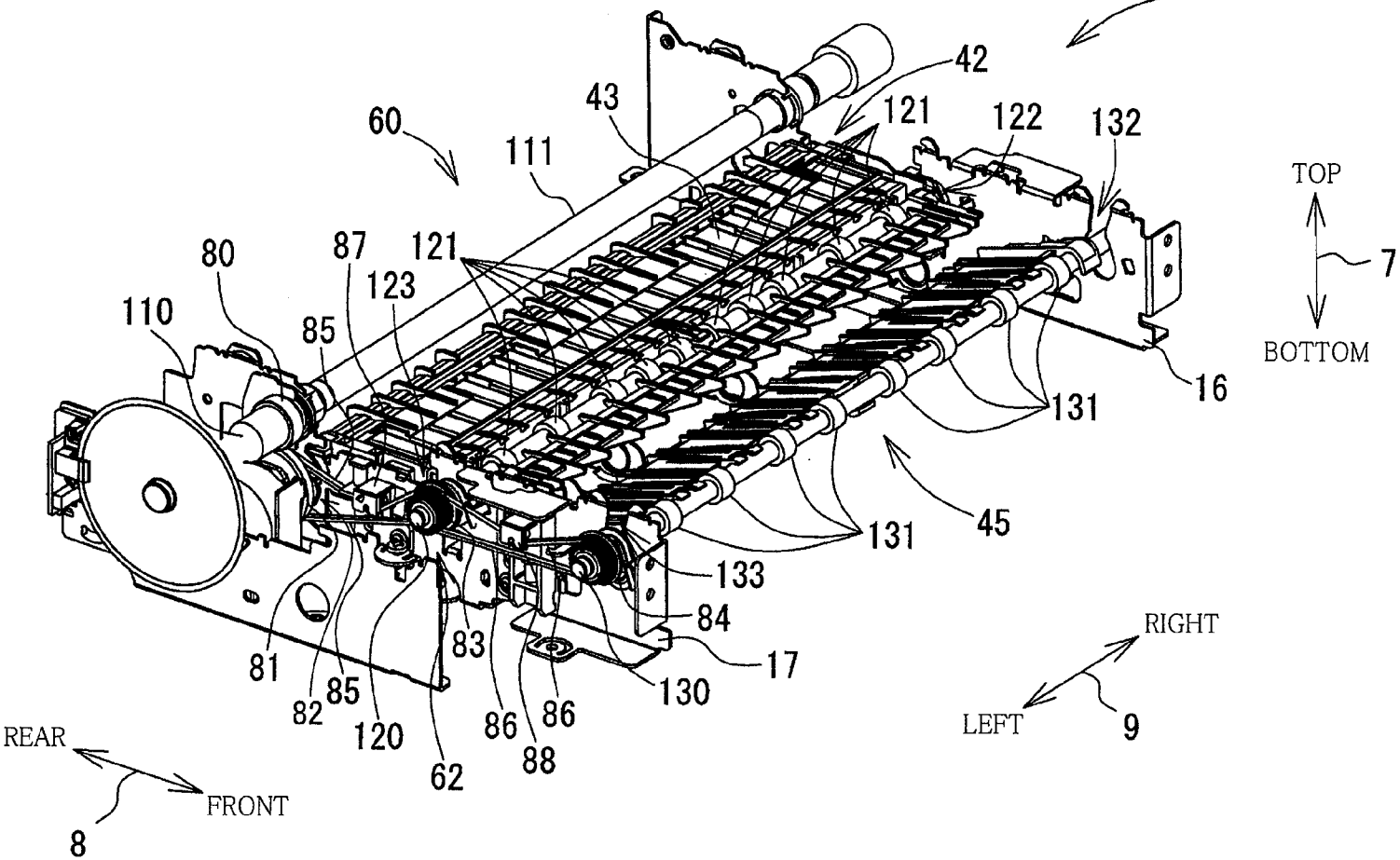
FIG. 3 is a perspective view of an example of embodiments of a carrying apparatus in the present invention.

As shown in FIG. 2, the printer portion 11 includes (1) a sheet-supply portion 15 which supplies the recording sheet, (2) a recording portion 24 of the inkjet recording type (as an example of a recording portion in the present invention) which records an image on the recording sheet, (3) a feeding device 12 (shown in FIGS. 3 and 4A-4C) as an example of a carrying apparatus in the present invention, and so forth. The printer portion 11 records an image on the recording sheet, based on print data and so on that are received from an external device and so forth. The MFD 10 also has a function in which the recording portion 24 records an image on a face or a surface of a recording medium such as a CD-ROM or a DVD-ROM that is larger in thickness than the recording sheet. This function will be described later.

The MFD 10 also includes a first feed path 65 as an example of a carry path in the present invention. The first feed path 65 is curved upward and to the front side of the MFD 10 from a rear end portion of the sheet-supply tray 20 so as to extend from a rear side of the MFD 10 to the front side thereof, and extends below the recording portion 24 and is connected to the sheet-discharge tray 21. The recording sheet is guided through the first feed path 65 in a feed direction or a feed way (a direction indicated by a one-dot chain line arrow in FIG. 2). The first feed path 65 is defined by an outer guide member 18 and an inner guide member 53 that are opposed to each other at a predetermined distance apart.

Above the sheet-supply tray 20, there is provided a sheet-supply portion 15. The sheet-supply portion 15 includes a sheet-supply roller 25, a sheet-supply arm 26 and a drive transmission mechanism 27. The sheet-supply roller 25 is rotatably supported by a free end of the sheet-supply arm 26 that is pivotable in the vertical direction 7 so as to move toward and away from the sheet-supply tray 20. The sheet-supply roller 25 is rotated when a drive force of a sheet-supply motor (not shown) is transmitted by the drive transmission mechanism 27 that has a plurality of gears meshed with each other. The sheet-supply roller 25 separates one of the recording sheets stacked on the sheet-supply tray 20 from the others and supplies the recording sheet to the first feed path 65.

The recording portion 24 includes a carriage 40 that carries a recording head 38 and is reciprocateable in a main scanning direction or in a direction perpendicular to a sheet face (plane) of FIG. 2. Ink is supplied from an ink cartridge/ink cartridges (not shown) to the recording head 38. The recording head 38 ejects tiny ink droplets from a plurality of nozzles 39. When the carriage 40 reciprocates in the main scanning direction, the recording head 38 is scanned relative to the recording sheet, so that an image is recorded on the recording sheet or a recording medium that is fed onto a platen 42 that is provided below the first feed path 65 to be opposed to the recording portion 24. The platen 42 has a support surface 43 to support a media tray 71 (as an example of a second carried object and a tray in the present invention) that accommodates the recording sheet and the recording medium. The media tray 71 will be described later.

[Second Pair of Rollers 44, Third Pair of Rollers 58, Fourth Pair of Rollers 59]

On an upstream side of the recording portion 24 in the feed direction, there are provided a third pair of rollers 58 which consist of (1) a first feed roller 60 (as an example of a second roller in the present invention) that is located in an upper portion of the first feed path 65 and (2) a plurality of first pinch rollers 61 that are located in a lower portion of the first feed path 65 and are opposed to the first feed roller 60. By an elastic member such as spring (not shown), each first pinch roller 61 is pressed into contact with a roller surface of a first circular member 111 (shown in FIG. 3) that constitutes the first feed roller 60 and will be later described. The supplied recording sheet is nipped and fed or carried onto the platen 42 by the third pair of rollers 58.

On a downstream side of the recording portion 24 in the feed direction, there are provided a fourth pair of rollers 59 which consist of (1) a second feed roller 62 (as an example of a first roller in the present invention) that is located on a lower side of the first feed path 65 and (2) a spur roller 63 (as an example of a third roller in the present invention) that is located in the upper portion of the first feed path 65 and is opposed to the second feed roller 62. Similarly to the first pinch rollers 61, the spur roller 63 is pressed into contact with the second feed roller 62. The recording sheet fed from the recording portion 24 is nipped and fed to the downstream side by the fourth pair of rollers 59.

On the downstream side of the fourth pair of rollers 59 in the feed direction, there are provided a second pair of rollers 44 which consists of (1) a third feed roller 45 (as an example of a fifth roller in the present invention) that is located on a lower side of the first feed path 65 and (2) a spur roller 46 that is located on an upper side of the first feed path 65 and is opposed to the third feed roller 45. Similarly to the first pinch rollers 61, the spur roller 46 is pressed into contact with the third feed roller 45. The recording sheet fed from the fourth pair of rollers 59 is nipped and fed to the sheet-discharge tray 21 or a second feed path 67 described later by the second pair of rollers 44.

The first feed roller 60 is rotated by a drive force transmitted from a feed motor (not shown, as an example of a drive source in the present invention) through a drive transmission mechanism (not shown). The drive transmission mechanism consists of a planetary gear and so forth. The first feed roller 60 is so rotated that, when the feed motor is rotated in one direction of forward and backward (in the present embodiment, forward), the recording sheet or the media tray 72 is fed or carried in the feed direction, while, when the feed motor is rotated in the other direction of forward and backward (in the present embodiment, backward), the recording sheet or the media tray 71 is fed or carried in an opposite direction (way) to the feed direction. The feed direction and the opposite direction to the feed direction correspond to a conveying direction in the present invention. As mentioned later, the second feed roller 62 is rotated by a drive force transmitted from the first feed roller 60 through a first belt 85 (shown in FIG. 3), and the third feed roller 45 is rotated by a drive force transmitted from the second feed roller 62 through a second belt 86 (shown in FIG. 3).

[Path Switching Portion 41]

There is provided a path switching portion 41 between the fourth pair of rollers 59 and the second pair of rollers 41 and on an upper side of the first feed path 65. A flap 49 of the path switching portion 41 is pivotally supported by a support shaft 50 that is disposed in the outer guide member 18. The flap 49 rotatably supports spur-like auxiliary rollers 47, 48. When images are recorded on both sides of the recording sheet, the recording sheet that is fed through the first feed path 65 is switched at the downstream side of a branch opening 36 in the feed direction and then fed to the second feed path 67 (described later) extending obliquely downward from the branch opening 36. The path switching portion 41 is pivotable between a discharge position (a position or a posture shown by a solid line in FIG. 2) where a bottom end of the auxiliary roller 48 is positioned higher in the vertical direction 7 than the branch opening 36 and a reverse position (a position or a posture shown by a broken line in FIG. 2) where the bottom end of the auxiliary roller 48 is positioned lower in the vertical direction 7 than the branch opening 36.

In a state in which the path switching portion 41 keeps at the reverse position under its own weight, when a leading end of the recording sheet being fed from the recording portion 24 to the downstream side in the feed direction reaches the path switching portion 41, the path switching portion 41 is pushed upward by an upper surface of the recording sheet and pivoted (changed in posture) from the reverse position to the discharge position. Then, when a trailing end portion or a rear end portion of the recording sheet reaches a specified position that is located on the upstream side of the auxiliary roller 48 in the feed direction, the path switching portion 41 is pivoted from the discharge position to the reverse position. Accordingly, the trailing end portion of the recording sheet is pressed downward by the auxiliary roller 48 to head to the second feed path 67. In a case where one-side printing is performed, the third feed roller 45 maintains a normal rotation, and the recording sheet is discharged onto the sheet-discharge tray 21. In a case where double-side printing is performed, in a state in which the trailing end portion of the recording sheet heads to the second feed path 67, the third feed roller 45 is switched from the normal rotation to a reverse rotation. Thus, the recording sheet is switched and fed to the second feed path 67.

[Second Feed Path 67]

The second feed path 67 is branched from the first feed path 65 at the branch opening 36, extends below the inner guide member 53 and above the sheet-supply portion 15, and the second feed path 67 and the first feed path 65 meet at a meeting point 37. The second feed path 67 is defined by the inner guide member 53 that is provided above the second feed path 67 and a lower guide member 33 that is provided below the second feed path 67. In the second feed path 67, there are provided a first pair of rollers 57 that consist of a fourth feed roller 68 and a spur roller 69. When the fourth feed roller 68 is rotated by a rotary force transmitted from a feed motor, the recording sheet is fed to a direction from the branch opening 36 to the meeting point 37.

[Media Tray 71]

Figure 6:
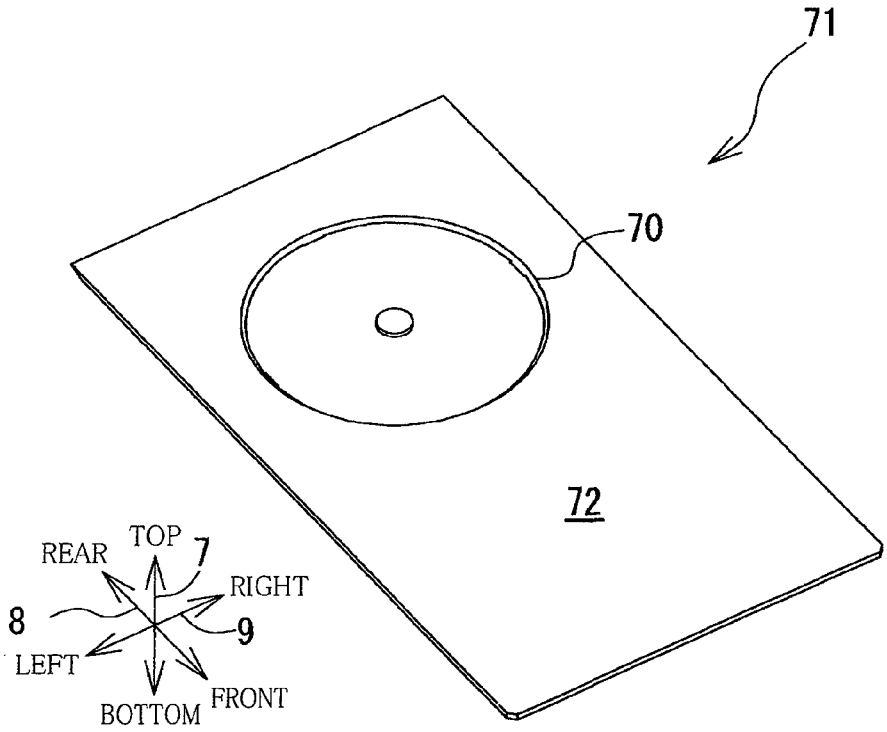
FIG. 6 is a perspective view of a media tray 71.

As mentioned before, the MFD 10 has the function to record an image on the surface of the recording medium such as a CD-ROM and a DVD-ROM. When the image is recorded on the recording medium, the recording medium is placed on the media tray 71. The media tray 71 is, in a state of being placed on a tray guide 76 that is provided in the opening 13, inserted along the first feed path 65 in a direction indicated by an arrow 77. As shown in FIG. 6, the media tray 71 is a flat rectangular parallelepiped resin plate. On an upper surface 72 of the media tray 71, there is formed a media placing portion 70 that is a circular recess in which the recording medium can be placed.

[Feeding Device 12]

As shown in FIGS. 3 and 4A-4C, the feeding device 12 includes, as described above, the first feed path 65, the first feed roller 60, the second feed roller 62, the spur roller 63 and the third feed roller 45, and also includes a first gear 80, a second gear 81, a first pulley 82, a second pulley 83, a third pulley 84, the first belt 85, the second belt 86, a first tensioner 87, a second tensioner 88, a second pinch roller 89 as an example of a fourth roller in the present invention, and so forth.

The first feed roller 60 consists of a first rotary shaft 110 and a first circular member 111, formed of an elastic member such as rubber, which is provided at the periphery of the first rotary shaft 110 in a circumferential direction and is contactable with the recording sheet and the media tray 71. The first feed roller 60 is rotatably supported on a right frame 16 and a left frame 17 of the printer portion 11 that are respectively disposed on opposite end portions of the first feed path 65 in the left-right direction 9. The first circular member 111 is located between the right frame 16 and the left frame 17 in the left-right direction 9. The first gear 80 having teeth over the entire circumference is attached to a left side of the left frame 17 in the first rotary shaft 110 in the left-right direction 9. The first gear 80 is rotated integrally with the first feed roller 60 about the first rotary shaft 110.

The plurality of first pinch rollers 61 are spaced from each other in the left-right direction 9. Each first pinch roller 61 is pressed into contact with the roller surface of the first circular member 111 by the elastic member such as spring and is rotated with the rotation of the first feed roller 60.

The second gear 81 is attached to a second rotary shaft 113. The second rotary shaft 113 is rotatably supported on the right frame 16 and the left frame 17. The second gear 81 is rotated about the second rotary shaft 113. The second gear 81 is opposed to the first gear 80 and meshes with the same 80.

The first pulley 82 is attached to the second rotary shaft 113 that is located at a position between the left frame 17 and the second gear 81 in the left-right direction 9. The first pulley 82 is rotated integrally with the second gear 81 about the second rotary shaft 113. The first belt 85 is wound along a circumferential surface of the first pulley 82. In the present embodiment, a drive force is transmitted to the first pulley 82 from the feed motor through the first gear 80 and the second gear 81, but the drive force from the feed motor may be transmitted to the first pulley 82 without via the first gear 80 and the second gear 81.

The second feed roller 62 consists of a third rotary shaft 120 and a plurality of second circular members 121, formed of an elastic member such as rubber, which are provided at the periphery of the third rotary shaft 120 in the circumferential direction and are contactable with the recording sheet and the media tray 71. The plurality of second circular members 121 are spaced from each other in the left-right direction 9. There are respectively formed a first right cutout 122 and a first left cutout 123 in the respective frames 16, 17. Opposite end portions of the third rotary shaft 120 in the left-right direction 9 are respectively inserted in the first right cutout 122 and the first left cutout 123. Since the third rotary shaft 120 is supported by the right frame 16 and the left frame 17, the second feed roller 62 is rotatably supported, on a right side of the right frame 16 and on a left side of the left frame 17, by a first guide member 54 (shown in FIG. 2) that is movable in the vertical direction 7 and the front-rear direction 8 and that will be described later. A direction in which the first right cutout 122 and the first left cutout 123 extend is in parallel with a direction in which the second feed roller 62 is moved between a first position and a second position that will be described later. In other words, the direction of extension of the first right cutout 122 and the first left cutout 123 defines the direction of the movement of the second feed roller 62 between the first position and the second position.

The second pulley 83 is attached to the left side of the left frame 17 in the third rotary shaft 120. The second pulley 83 is rotated integrally with the second feed roller 62 about the third rotary shaft 120. A circumferential surface of the second pulley 83 is divided into a right area (side) and a left area (side). The first belt 85 is wound on the right-side circumferential surface of the second pulley 83, and the second belt 86 is wound on the left-side circumferential surface thereof.

The endless annular first belt 85 is stretched between the first pulley 82 and the second pulley 83. One of opposite portions of the first belt 85 is wound on a circumferential surface of the first pulley 82 and the other thereof is wound on the right-side circumferential surface of the second pulley 83. The first belt 85 is circulated by rotation of the first pulley 82. The second pulley 83 is rotated by circulation of the first belt 85. In other words, a rotary drive force of the first pulley 82 is transmitted to the second pulley 83 through the first belt 85.

The first tensioner 87 consists of a first tensioner roller 90 and a first tensioner support portion 91. The first tensioner support portion 91 supports the first tensioner roller 90 such that the roller 90 is freely rotatable. The first tensioner support portion 91 is attached to a left side surface of the left frame 17 at a position where at least a bottom end of the first tensioner roller 90 is located below the height level of a top end of the first pulley 82 and a top end of the second pulley 83. An upper surface of an upper portion of the first belt 85 that is located between the first pulley 82 and the second pulley 83 is wound on a lower circumferential surface of the first tensioner roller 90. Accordingly, a tension in a downward direction is applied to the first belt 85 by the first tensioner roller 90. In other words, the first tensioner 87 pulls the first belt 85 in a direction away from the first feed path 65.

The third feed roller 45 consists of a fourth rotary shaft 130 and a plurality of third circular members 131, formed of an elastic member such as rubber, which are provided at the periphery of the fourth rotary shaft 130 in the circumferential direction and are contactable with the recording sheet and the media tray 71. The plurality of third circular members 131 are spaced from each other in the left-right direction 9. In the frames 16, 17, there are formed a second right cutout 132 and a second left cutout 133, respectively. Opposite end portions (a left end portion and a right end portion) of the fourth rotary shaft 130 in the left-right direction 9 are respectively inserted in the second right cutout 132 and the second left cutout 133. Since the fourth rotary shaft 130 is supported by the right frame 16 and the left frame 17, the third feed roller 45 is rotatably supported, on the right side of the right frame 16 and on the left side of the left frame 17, by a second guide member 55 (shown in FIG. 2) that is movable in the vertical direction 7 and the front-rear direction 8 and that will be described later. A direction in which the second right cutout 132 and the second left cutout 133 extend is in parallel with a direction in which the third feed roller 45 is moved between a third position and a fourth position that will be described later. In other words, the direction of extension of the second right cutout 132 and the second left cutout 133 defines or coincides with the direction of the movement of the third feed roller 45 between the third position and the fourth position.

The third pulley 84 is attached to the fourth rotary shaft 130 on the left side of the left frame 17. The third pulley 84 is rotated integrally with the third feed roller 45 about the fourth rotary shaft 130. The second belt 86 is wound on a circumferential surface of the third pulley 84.

The endless annular second belt 86 is stretched between the second pulley 83 and the third pulley 84. One of opposite portions of the second belt 86 is wound on the left-side circumferential surface of the second pulley 83, that is, a circumferential surface of the second pulley 83 different in an axial direction from a circumferential surface thereof on which the first belt 85 is wound, and the other of the second belt 86 is wound on the circumferential surface of the third pulley 84. The second belt 86 is circulated by the rotation of the second pulley 83. The third pulley 84 is rotated by the circulation of the second belt 86. In other words, a rotary drive force of the second pulley 83 is transmitted to the third pulley 84 through the second belt 86.

The second tensioner 88 consists of a second tensioner roller 92 and a second tensioner support portion 93. The second tensioner support portion 93 supports the second tensioner roller 92 such that the roller 92 is freely rotatable. The second tensioner support portion 93 is attached to the left side surface of the left frame 17 at a position where at least a bottom end of the second tensioner roller 92 is located below the height level of a top end of the second pulley 83 and a top end of the third pulley 84. An upper surface of an upper portion of the second belt 86 that is located between the second pulley 83 and the third pulley 84 is wound on a lower portion of a circumferential surface of the second tensioner roller 92. Accordingly, a tension in a downward direction is applied to the second belt 86 by the second tensioner roller 92. In other words, the second tensioner 88 pulls the second belt 86 in a direction away from the first feed path 65.

As shown in FIG. 2, the second pinch roller 89 is provided on the downstream side of the spur roller 63 in the feed direction and in the upper portion of the first feed path 65. The second pinch roller 89 is, as described later, located at a position opposed to the second feed roller 62 that is moved to the second position by the first guide member 54. Further, the spur roller 63 is located at a position opposed to the second feed roller 62 that is positioned at the first position described later. Similarly to the first pinch roller 61, the second pinch roller 89 consists of a rotary shaft (not shown) and a circular member (not shown), and is rotatably supported on a frame (not shown) of the printer portion 11. It is preferable that the second pinch roller 89 is located right above the second feed roller 62 that is positioned at the second position, and in the present embodiment, the second pinch roller 89 is located right above the second feed roller 62 at the second position. In other words, a straight line connecting between a center of a rotary shaft of the second pinch roller 89 and the third rotary shaft 120 of the second feed roller 62 is a line that extends in a direction perpendicular to the feed direction at a nipping position of the fourth pair of rollers 59. For example, the straight line is a line extending in the vertical direction 7.

[First Member Operating Mechanism 94 and Second Member Operating Mechanism 95]

The second feed roller 62 is movable between the first position (shown in FIG. 4A and indicated by a solid line in FIG. 2), and the second position (shown in FIG. 4C and indicated by a broken line in FIG. 2) that is located below the first position (a side away from the first feed path 65) and on a front side of the first position (a side away from the first tensioner 87), that is, the second position is located on an obliquely front and lower side of the first position. The second feed roller 62 positioned at the first position is pressed into contact with the spur roller 63 and the recording sheet can be nipped between the second feed roller 62 and the spur roller 63 to be fed. The second feed roller 62 positioned at the second position can nip and carry the media tray 71 with the second pinch roller 89.

When the second feed roller 62 is moved to a position below the first position, the tension applied to the first belt 85 by the first tensioner 87 is decreased. On the other hand, when the second feed roller 62 is moved frontward from the first position, the tension applied to the first belt 85 by the first tensioner 87 is increased. The second position is such a position that the decrease of the tension of the first tensioner 87 due to the movement of the second feed roller 62 to the position below the first tensioner 87 is equal to the increase of the tension thereof due to the frontward movement of the same 62. In other words, when the second feed roller 62 is positioned at the second position, the first tensioner 87 applies to the first belt 85 the tension equivalent to the tension applied by the first tensioner 87 to the first belt 85 when the second feed roller 62 is positioned at the first position.

The second feed roller 62 is arranged such that an upper end thereof is located above the height level of the support surface 43 of the platen 42 in any of these two cases where the second feed roller 62 is positioned at the first position and where the same 62 is positioned at the second position.

The third feed roller 45 is movable between the third position (shown in FIG. 4A and indicated by a solid line in FIG. 2), and the fourth position (shown in FIG. 4C and indicated by a broken line in FIG. 2) that is below and on a front side of the third position, that is, the fourth position is located on an obliquely front and lower side of the third position. The third feed roller 45 positioned at the third position is pressed into contact with the spur roller 46, and the recording sheet can be nipped and fed by the third feed roller 45 and the spur roller 46.

When the third feed roller 45 is moved to a position below the third position, the tension applied to the second belt 86 by the second tensioner 88 is decreased. On the other hand, when the third feed roller 45 is moved frontward from the third position, the tension applied to the second belt 86 by the second tensioner 88 is increased. The fourth position is such a position that the decrease of the tension of the second tensioner 88 due to the movement of the third feed roller 45 to the position below the second tensioner 88 is equal to the increase of the tension thereof due to the frontward movement of the same 45. In other words, when the third feed roller 45 is positioned at the fourth position, the second tensioner 88 applies to the second belt 86 the tension equivalent to the tension applied by the second tensioner 88 to the second belt 86 when the third feed roller 45 is positioned at the third position.

The third feed roller 45 positioned at the fourth position is spaced away from the spur roller 46. As shown in FIG. 2, the third feed roller 45 positioned at the third position is located above the height level of the second feed roller 62 positioned at the first position. Further, the third feed roller 45 positioned at the fourth position is located below the height level of the second feed roller 62 positioned at the second position. Since the upper end of the third feed roller 45 positioned at the fourth position is located below the height level of the support surface 43 of the platen 42, the third feed roller 45 at the fourth position does not carry the media tray 71.

In FIGS. 2 and 5A-5D, for easy understanding of movement of each roller 62, 45, respective amounts of the movement of the rollers 62, 45 are shown in a larger way than actual amounts of the movement of the respective rollers 62, 45.

In order to perform the above-described movements of the respective feed motors 62, 45, as shown in FIG. 2, in the printer portion 11, there are provided a first member operating mechanism 94 as an example of a first moving mechanism in the present invention and a second member operating mechanism 95 as an example of a second moving mechanism in the present invention.

The first member operating mechanism 94 includes the first guide member 54, a first eccentric cam 96 which moves the first guide member 54 and the second feed roller 62 in the vertical direction 7, and the first right cutout 122 and the first left cutout 123 which allow the second feed roller 62 to move in the front-rear direction 8. The second member operating mechanism 95 includes the second guide member 55, a second eccentric cam 97 which moves the second guide member 55 and the third feed roller 45 in the vertical direction 7, and the second right cutout 132 and the second left cutout 133 which allow the third feed roller 45 to move in the front-rear direction 8. The first, second member operating mechanisms 94, 95 may have other configurations as long as they can move the respective rollers 62, 45 in the vertical direction 7 and the front-rear direction 8.

The first eccentric cam 96 is disposed below the first guide member 54 in a state in which the first eccentric cam 96 is pressed into contact with the first guide member 54. The first eccentric cam 96 is supported by the frame (not shown) and the like of the printer portion 11 so as to be rotatable about a first shaft 99 as a rotary shaft extending in the left-right direction 9. The first eccentric cam 96 is a disk whose diameter from the first shaft 99 is periodically changed. The first guide member 54 is supported so as to be placed on the first eccentric cam 96. The first eccentric cam 96 is rotated by a drive force transmitted from a first cam motor (not shown). When the first eccentric cam 96 is rotated, a circumferential surface thereof slides relative to the first guide member 54. Because the diameter of the circumferential surface of the first eccentric cam 96 from the first shaft 99 is periodically changed, the first guide member 54 is moved in the vertical direction 7 based on the change of the diameter thereof. The first guide member 54 has a through-hole through which the third rotary shaft 120 extends such that the opposite ends of the third rotary shaft 120 are supported on the right frame 16 and the left frame 17 while the first guide member 54 rotatably supports the third rotary shaft 120 that is a rotary shaft of the second feed roller 62.

Figure 4A:
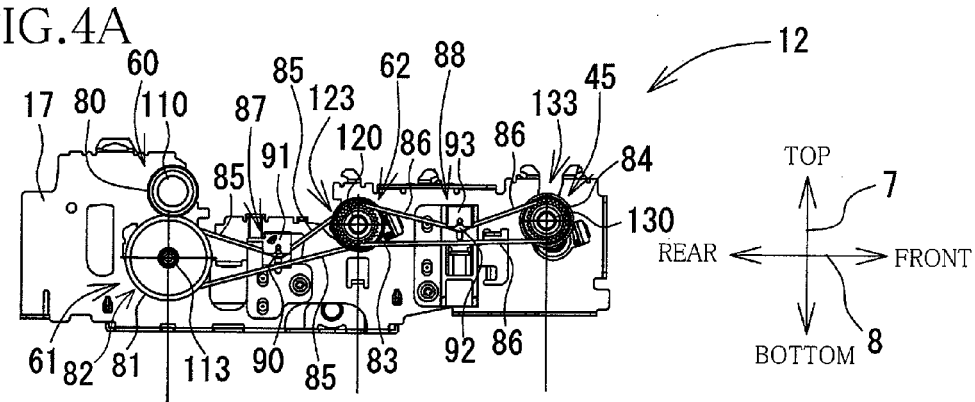
FIGS. 4A through 4C are side cross-sectional views of the carrying apparatus.
Figure 4B:
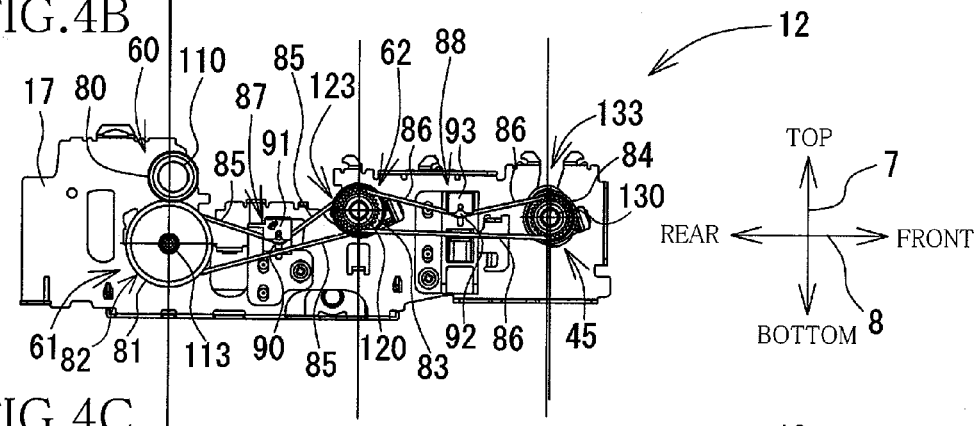
Figure 4C:
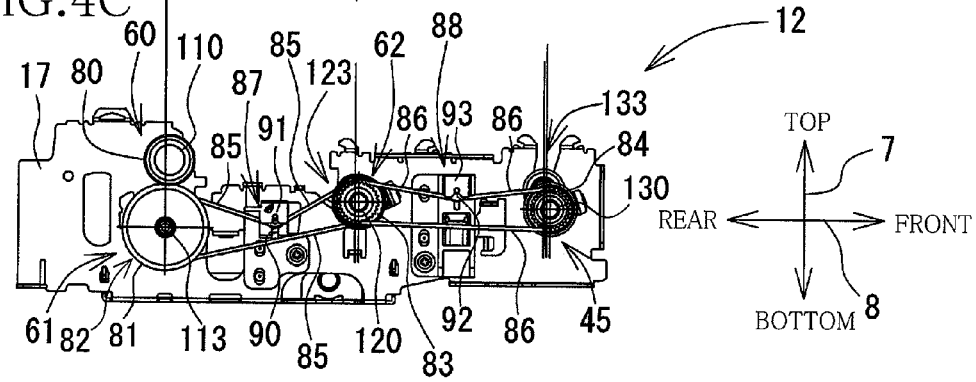
Figure 5A:
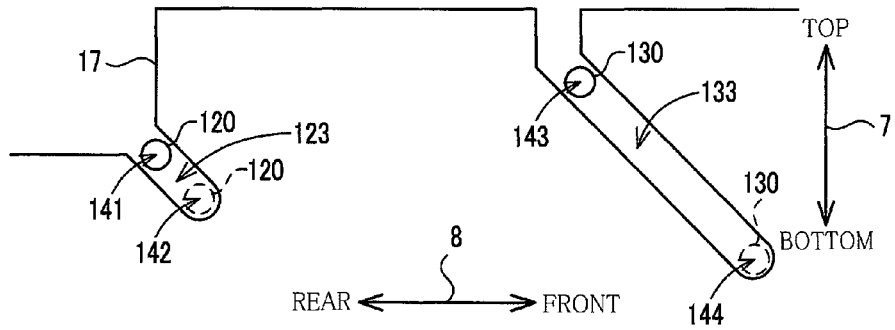
FIGS. 5A through 5D are side cross-sectional views schematically showing the carrying apparatus.

As shown in FIGS. 3 through 5A-5B, the first right cutout 122 and the first left cutout 123 extend obliquely in such a way that respective rear ends thereof are in an upper position and respective front ends thereof in a lower position. Accordingly, when the second feed roller 62 is moved in the vertical direction 7 by the rotation of the first eccentric cam 96, the second feed roller 62 is movable only along the cutouts 122, 123, that is, movable between a first position 141 and a second position 142. When the third rotary shaft 120 is positioned at the first position 141 at which the third rotary shaft 120 is positioned at an open end portion of the first left cutout 123 as shown in FIG. 5A, the second feed roller 62 is positioned at the first position, and when the third rotary shaft 120 is at the second position 142 at which the third rotary shaft 120 is at a closed end portion of the first left cutout 123, the second feed roller 62 is positioned at the second position. Because the second position 142 is located at the closed end portion of the first left cutout 123, even in a case where the first eccentric cam 96 is rotated too much, the third rotary shaft 120 is maintained at the second position 142, so that the second feed roller 62 can be accurately positioned at the second position.

As shown in FIG. 2, the second eccentric cam 97 is disposed below the second guide member 55 in a state in which the second eccentric cam 97 is pressed into contact with the second guide member 55. The second eccentric cam 97 is supported by the frame (not shown) of the printer portion 11 so as to be rotatable about a second shaft 100 as a rotary shaft extending in the left-right direction 9. The second eccentric cam 97 is a disk whose diameter from the second shaft 100 is periodically changed. The second guide member 55 is supported so as to be placed on the second eccentric cam 97. The second eccentric cam 97 is rotated by a drive force transmitted from a second cam motor (not shown) different from the first cam motor. When the second eccentric cam 97 is rotated, a circumferential surface thereof slides relative to the second guide member 55. Because the diameter of the circumferential surface of the second eccentric cam 97 from the second shaft 100 is periodically changed, the second guide member 55 is moved in the vertical direction 7 based on the change of the diameter thereof. The second guide member 55 has a through-hole through which the fourth rotary shaft 130 extends such that the opposite ends of the fourth rotary shaft 130 are supported on the right frame 16 and the left frame 17 while the second guide member 55 rotatably supports the fourth rotary shaft 130 that is a rotary shaft of the third feed roller 45.

As shown in FIGS. 3 through 5A-5B, the second right cutout 132 and the second left cutout 133 extend obliquely in such a way that respective rear ends thereof are in an upper position and respective front ends thereof in a lower position. Accordingly, when the third feed roller 45 is moved in the vertical direction 7 by the rotation of the second eccentric cam 97, the third feed roller 45 is movable only along the cutouts 132, 133, that is, movable between a third position 143 and a fourth position 144. When the fourth rotary shaft 130 is positioned at the third position 143 at which the fourth rotary shaft 130 is positioned at an open end portion of the second left cutout 133 as shown in FIG. 5A, the third feed roller 45 is positioned at the third position, and when the fourth rotary shaft 130 is at the fourth position 144 at which the fourth rotary shaft 130 is at a closed end portion of the second left cutout 133, the third feed roller 45 is positioned at the fourth position. Because the fourth position 144 is located at the closed end portion of the second left cutout 133, even in a case where the second eccentric cam 97 is rotated too much, the fourth rotary shaft 130 is maintained at the fourth position 144, so that the third feed roller 45 can be accurately positioned at the fourth position.

The diameters of the respective eccentric cams 96, 97 and positions of the shafts 99, 100 thereof are adjusted such that displacement of the third feed roller 45 from the third position to the fourth position in the vertical direction 7 is made larger than that of the second feed roller 62 from the first position to the second position in the vertical direction 7. In the present embodiment, as an example of the above-described adjustment, the diameter of the second eccentric cam 97 is made larger than that of the first eccentric cam 96.

[Movement of Second Feed Roller 62 and Third Feed Roller 45]

Hereinafter, there will be described a procedure for having the media tray 71 be in a state of being insertable into the MFD 10, when an image is recorded on the recording medium such as a CD-ROM and a DVD-ROM. When image recording on the recording medium is instructed by an instructing means, not shown, the second cam motor is driven. Accordingly, the second eccentric cam 97 is rotated, and the third feed roller 45 is moved from the third position to the fourth position.

When a sensor (not shown) detects that the third feed roller 45 has reached the fourth position, the first cam motor is driven. Accordingly, the first eccentric cam 96 is rotated, and the second feed roller 62 is moved from the first position to the second position. That is, the first member operating mechanism 94 includes the above-mentioned sensor. The first member operating mechanism 94 moves the second feed roller 62 from the first position to the second position under a condition that the movement of the third feed roller 45 from the third position to the fourth position by the second member operating mechanism 95 is completed.

The path switching portion 41 is also pivoted from the reverse position to the discharge position. This change in position is, for example, performed by transmission of a drive force from a motor and the like to the path switching portion 41, with an instruction by the instructing means being as a trigger. As a result of the above-mentioned operations, the media tray 71 becomes in the state of being insertable into the opening 13 of the MFD 10 along the first feed path 65 in the direction indicated by the arrow 77.

[Effects of Present Embodiment]

When the second feed roller 62 is moved, a tension applied to the first belt 85 by the first tensioner 87 may be changed. When the tension applied to the first belt 85 is changed, transmission of a drive force between the rollers may not be properly performed, leading to an unstable carrying performance of the media tray 71. In the present embodiment, however, even when the second feed roller 62 has been moved from the first position to the second position, the tension applied to the first belt 85 can be equal to that when the second feed roller 62 is positioned at the first position. Therefore, the first roller 85 can be moved without excessive change in the tension applied to the first belt 85.

In a case where the first tensioner 87 is located at a position where the first tensioner 87 pulls the first belt 85 in the direction away from the first feed path 65, when the second feed roller 62 is moved in the direction away from the first feed path 65, the tension applied to the first belt 85 by the first tensioner 87 is decreased. In the present embodiment, however, even in that case the second feed roller 62 is moved in the direction away from the first feed path 65 and also in a direction away from the first tensioner 87, the decrease in the tension applied to the first belt 85 is prevented.

As in the present embodiment, in a case where the first feed roller 60 and the second feed roller 62, to which the drive force is transmitted from the feed motor, are respectively located on opposite sides of the first feed path 65, when the second feed roller 62 and the first feed roller 60 are connected with each other directly by the first belt 85 and a drive force is transmitted from the first feed roller 60 to the second feed roller 62, the recording sheet and the media tray 71 cannot be carried. This is because one of the rollers rotates so as to guide the recording sheet and the media tray 71 in the feed direction, while the other roller is rotated so as to guide the recording sheet and the media tray 71 in the opposite direction to the feed direction, that is, the first feed roller 60 and the second feed roller 62 are rotated in the opposite direction relative to the movement of the recording sheet and the media tray 71. In the present embodiment, however, the drive force transmitted, through the first gear 80 and the second gear 81, to the first feed roller 60 from the feed motor is transmitted to the first pulley 82 that is disposed on the same side of the first feed path 65 as the second feed roller 62. Therefore, the first feed roller 60 and the second feed roller 62 are rotated in the same direction relative to the movement of the recording sheet and the media tray 71 so as to carry the recording sheet and the media tray 71.

In a case where the second feed roller 62 and the spur roller 63 nip and feed the recording sheet, in order to feed the recording sheet stably, the second feed roller 62 and the spur roller 63 is preferably provided to be opposed to each other, and in the present embodiment, the rollers 62, 63 are opposed to each other. Accordingly, the recording sheet is nipped and fed by the second feed roller 62 at the first position and the spur roller 63 that are opposed to each other. However, when the second feed roller 62 is moved from the first position to the second position, the second feed roller 62 and the spur roller 63 are not opposed to each other. In this case, when the media tray 71 is carried by the fourth pair of rollers 59, a moment is produced in the media tray 71 due to forces received in opposite directions from the respective rollers 62, 63 that are not opposed to each other. As a result, the media tray 71 may be deformed, or may not be carried with stability.

In the present embodiment, however, the second pinch roller 89 is disposed so as to be opposite to the second feed roller 62 at the second position. Therefore, the media tray 71 is nipped and carried by the second feed roller 62 at the second position and the second pinch roller 89 that are opposed to each other. It can reduce the possibility of deformation of the media tray 71, and also the media tray 71 can be carried with stability.

Further, in the present embodiment, the straight line that connects the center of the rotary shaft of the second pinch roller 89 and the third rotary shaft 120 of the second feed roller 62 extends perpendicularly to the feed direction at the nipping position of the fourth pair of rollers 59. Accordingly, no moment occurs in the media tray 71 due to the forces received from the respective rollers 62, 89. It can reduce the possibility of deformation of the media tray 71, and also the media tray 71 can be carried with stability.

In a case where the second feed roller 62 is moved before the third feed roller 45 starts to move, a tension applied to the second belt 86 changes because of the movement of the second feed roller 62. In the present embodiment, however, the second feed roller 62 is moved after the movement of the third feed roller 45 is completed. The completion of the movement of the third feed roller 45 gives the second belt 86 such a tension that a change in tension by the movement of the second feed roller 62 has been considered. Therefore, even when the second feed roller 62 is moved after the movement of the third feed roller 45, it is restrained that the movement of the second feed roller 62 influences the change in tension applied to the second belt 86.

Modified Embodiment 1

In the illustrated embodiment, there was described a case where the second feed roller 62 is moved after the third feed roller 45 reaches the fourth position. However, the first member operating mechanism 94 may move the second feed roller 62 may be moved from the first position to the second position under a condition that the third feed roller 45 starts to be moved from the third position to the fourth position. For example, such a movement can be performed by a configuration in which drive instructions to the first cam motor and the second cam motor are simultaneously ordered by a controller (not shown) that controls entire operations of the MFD 10. Alternatively, such a movement can be performed by a configuration in which, after the drive instruction is given to the second cam motor, the drive instruction is given to the first cam motor.

In a case where the second feed roller 62 is moved before the third feed roller 45 starts to be moved, a tension applied to the second belt 86 is unfortunately changed because of the movement of the second feed roller 62. In the modified embodiment 1, however, the second feed roller 62 is never be moved before the third feed roller 45 starts to be moved. Therefore, it can be restrained that the movement of the second feed roller 62 influences the change in tension applied to the second belt 86.

Modified Embodiment 2

In the illustrated embodiment, such case was described that the second member operating mechanism 95 moves the third feed roller 45 between the third position 143 and the fourth position 144 as shown in FIGS. 4A and 4C and in FIG. 5A. However, in addition to the third position 143 and the fourth position 144, the second member operating mechanism 95 may move the third feed roller 45 to a fifth position 145 that is located on a path connecting between the third position 143 and the fourth position 144, as shown in FIGS. 4B and 5B.

Here, the fifth position 145 is a position at which the third feed roller 45 has been moved from the fourth position 144 toward the third position 143 by the same distance as that from the first position 141 to the second position 142 and in the same direction as that from the first position 141 to the second position 142. That is, the distance and the direction from the first position 141 to the second position 142 are the same as the distance and the direction from the fifth position 145 to the fourth position 144. Since the distance and the direction from the fifth position 145 to the fourth position 144 are the same as those from the first position 141 to the second position 142, as shown in FIG. 5B, a distance from the third position 143 to the fourth position 144 is longer than that from the first position 141 to the second position 142.

Figure 5B:
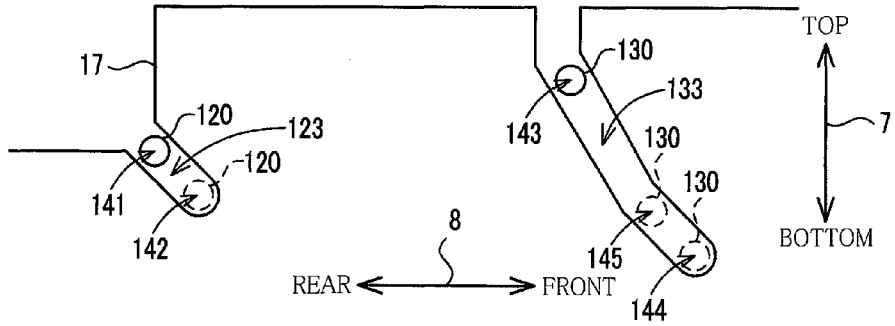
Figure 5C:
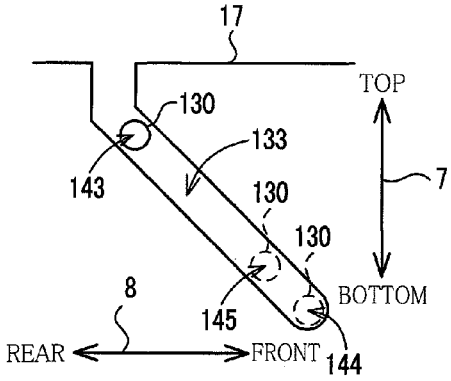
Figure 5D:
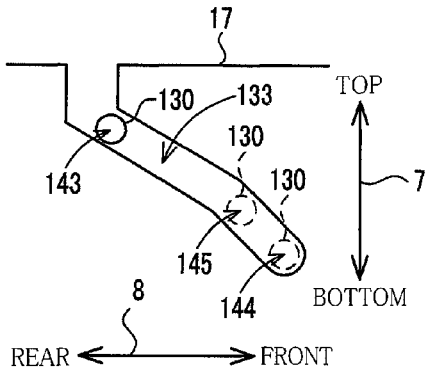

FIG. 5B shows a case where a slope from the third position 143 to the fifth position 145 is steeper than that from the fifth position 145 to the fourth position 144. However, as shown in FIG. 5C, the slope from the third position 143 to the fifth position 145 may be the same as that from the fifth position 145 to the fourth position 144. Further, as shown in FIG. 5D, the slope from the third position 143 to the fifth position 145 may be gentler than that from the fifth position 145 to the fourth position 144.

Hereinafter, there will be described a procedure, in the modified embodiment 2, for having the media tray 71 be in a state of being insertable into the MFD 10 when an image is recorded on the recording medium. When image recording on the recording medium is instructed by the instructing means, not shown, the second cam motor is driven. Accordingly, the second eccentric cam 97 is rotated, and the third feed roller 45 is moved from the third position 143 to the fifth position 145.

When a sensor (not shown) has detected that the third feed roller 45 has reached the fifth position 145, the first cam motor is driven. Accordingly, the first eccentric cam 96 is rotated, and the first guide member 54 is moved downward. The second eccentric cam 97 also continues to be rotated, and the second guide member 55 is moved downward. As a result, at the same time as the second feed roller 62 starts to be moved from the first position 141 to the second position 142, the third feed roller 45 is moved from the fifth position 145 to the fourth position 144.

That is, the first member operating mechanism 94 includes the above-mentioned sensor. The first member operating mechanism 94 moves the second feed roller 62 from the first position 141 to the second position 142 under a condition that the movement of the third feed roller 45 from the third position 143 to the fifth position 145 by the second member operating mechanism 95 is completed. Further, the second member operating mechanism 95 moves the third feed roller 45 from the fifth position 145 to the fourth position 144 at the same time as the second feed roller 62 starts to be moved from the first position 141 to the second position 142 by the first member operating mechanism 94.

The second cam motor may be once stopped when the third feed roller 45 reaches the fifth position 145, and then start to be driven again at the same time as the first cam motor starts to be driven. In this configuration, drive instructions to the first cam motor and the second cam motor are simultaneously ordered by a controller (not shown) that controls entire operations of the MFD 10.

The path switching portion 41 is also pivoted from the reverse position to the discharge position. This change in position is, for example, performed by transmission of a drive force from a motor and the like to the path switching portion 41, with an instruction by the instructing means being as a trigger. As a result of the above-mentioned operations, the media tray 71 becomes in the state of being insertable into the opening 13 of the MFD 10 along the first feed path 65 in the direction indicated by the arrow 77.

In the modified embodiment 2, because, for the same reason as in the illustrated embodiment, the third feed roller 45 is moved from the third position 143 to the fifth position 145 before the movement of the second feed roller 62 from the first position 141 to the second position 142, it can be restrained that the movement of the second feed roller 62 influences the change in tension applied to the second belt 86. Furthermore, in the modified embodiment 2, the third feed roller 45 is moved from the fifth position 145 to the fourth position 144 at the same time as the second feed roller 62 starts to be moved from the first position 141 to the second position 142. Here, the fifth position 145 is the position at which the third feed roller 45 has been moved from the fourth position 144 toward the third position 143 by the same distance as that from the first position 141 to the second position 142 and in the same direction as that from the first position 141 to the second position 142. Therefore, the second feed roller 62 that is moved from the first position 141 to the second position 142 and the third feed roller 45 that is moved from the fifth position 145 to the forth position 144 are moved in parallel with each other. Accordingly, a load to the second belt 86 due to the movement of the second feed roller 62 can be minimized.

Modified Embodiment 3

As shown in FIGS. 3 and 4A-4C, the illustrated embodiment illustrates that the first tensioner 87 is attached to the left side surface of the left frame 17 at the position where at least the bottom end of the first tensioner roller 90 is located below the height level of the top end of the first pulley 82 and the top end of the second pulley 83, and the upper surface of the upper portion of the first belt 85 that is located between the first pulley 82 and the second pulley 83 is wound on the lower circumferential surface of the first tensioner roller 90. However, the first tensioner 87 may be attached to the left side surface of the left frame 17 at a position different from the above-mentioned position.

Figure 7:
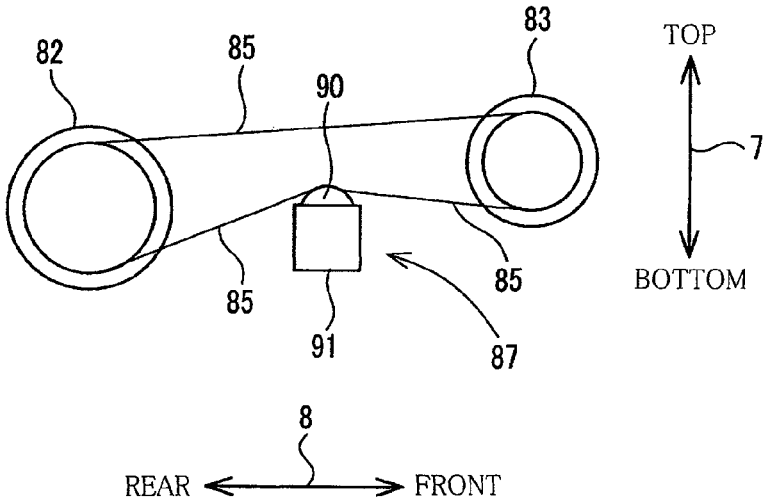
FIG. 7 is a side cross-sectional view schematically showing a first pulley 82, a second pulley 83 and a first tensioner 87 of a carrying apparatus in a modified embodiment 3 to which the present invention is applied.

For example, as shown in FIG. 7, the first tensioner 87 may be attached to the left side surface of the left frame 17 at a position where at least a top end of the first tensioner roller 90 is located above the height level of a bottom end of the first pulley 82 and a bottom end of the second pulley 83, and a lower surface of a lower portion of the first belt 85 that is located between the first pulley 82 and the second pulley 83 is wound on an upper circumferential surface of the first tensioner roller 90.

In this configuration, a tension in an upward direction is applied to the first belt 85 by the first tensioner roller 90. In other words, the first tensioner 87 pulls the first belt 85 in a direction closer to the first feed path 65.

In this case, the second position is located at a position below the first position (i.e., the position farther from the first feed path 65) and at a position on a rear side of the first position (i.e., the position nearer to the first tensioner 87 than the first position). That is, the second position is located on an obliquely rear and lower side of the first position.

In a case where the first tensioner 87 is located at such a position as applying a tension to the first belt 85 in the direction closer to the first feed path 65, when the second feed roller 62 is moved in the direction away from the first feed path 65, the tension applied to the first belt 85 by the first tensioner 87 is increased, which may accelerate deterioration of the first belt 85, causing the first belt 85 to be stretched or broken. In the modified embodiment 3, the second feed roller 62 is moved in the direction nearer to the first tensioner 87 when it is moved in the direction away from the first feed path 65. Therefore, the tension applied to the first belt 85 by the first tensioner 87 is prevented from increasing. Further, since an amount of movement of the second feed roller 62 in the direction nearer to the first tensioner 87 is adjusted to such an amount that the tension applied to the first belt 85 remains unchanged, the tension applied to the first belt 85 is prevented from decreasing.

The second tensioner 88 may be structured in the same manner as the first tensioner 87 in the modified embodiment 3.

Modified Embodiment 4

The first feed roller 60 may be disposed below the first feed path 65. In this case, a positional relationship between each pair of rollers is turned upside down relative to the illustrated embodiment. In other words, the rollers 61, 62, 45 are respectively located in the upper portion of the first feed path 65, and the rollers 63, 46, 89 in the lower portion of the first feed path 65. Accompanied with this, a positional relationship among the components of the feeding device 12 is turned upside down relative to the illustrated embodiment.

Modified Embodiment 5

The MFD 10 may not have the third feed roller 45. For example, the MFD 10 only for one-side printing can adopt such a structure. In this case, the feeding device 12 consists of the first feed path 65, the first feed roller 60, the second feed roller 62, the first gear 80, the second gear 81, the first pulley 82, the second pulley 83, the first belt 85, the first tensioner 87, the second pinch roller 89 and the first member operating mechanism 94.

The first pulley 82 may be rotated by a drive source (not shown) which drives the sheet-supply roller 25, a suction pump (not shown) for maintenance of the recording head 38 and so on.

What is claimed is:

1. A carrying apparatus comprising:

a carry path which is defined to guide a first carried object and a second carried object which is larger in thickness than the first carried object;

a first pulley which is configured to be rotated by a drive force generated in a drive source;

a first roller which is provided on one side of opposite sides of the carry path;

a second pulley which is provided coaxially with the first roller and is configured to be rotated integrally with the first roller;

a first belt which is wound on the first pulley and the second pulley and is configured to be moved circumferentially between the first pulley and the second pulley;

a first tensioner which is fixed at a position where the first tensioner applies a predetermined tension to the first belt;

a first moving mechanism which is configured to move the first roller between (i) a first position at which the first roller carries the first carried object and (ii) a second position which is farther from the carry path than the first position and at which the first roller carries the second carried object;

a third roller which is provided on the other side of the carry path so as to be opposed to the first roller located at the first position and which is configured to carry the first carried object, while nipping the first carried object with the first roller; and a fourth roller which is provided on the other side of the carry path so as to be opposed to the first roller located at the second position and which is configured to carry the second carried object, while nipping the second carried object with the first roller, wherein the second position is a position at which a tension by the first tensioner to the first belt is substantially equal to the predetermined tension applied by the first tensioner to the first belt where the first roller is positioned at the first position.

2. The carrying apparatus according to claim 1, wherein the first tensioner is located at a position where the first tensioner applies a tension to the first belt in a direction away from the carry path, and wherein the second position is a position where the first roller is farther from the carry path than the first roller located at the first position and where the first roller is farther from the first tensioner than the first roller located at the first position.

3. The carrying apparatus according to claim 1, wherein the first tensioner is located at a position where the first tensioner applies a tension to the first belt toward the carry path, and wherein the second position is a position where the first roller is farther from the carry path than the first roller located at the first position and where the first roller is nearer to the first tensioner than the first roller located at the first position.

4. The carrying apparatus according to claim 1, further comprising:

a first rotary shaft which supports the first roller; and a pair of frames each of which is disposed at a corresponding one of the opposite ends of the first rotary shaft, wherein each of the pair of frames has a first slit which guides the first rotary shaft so as to allow the first roller to move between the first position and the second position.

5. The carrying apparatus according to claim 4, wherein the first slit extends in a direction parallel to a direction from the first position toward the second direction.

6. The carrying apparatus according to claim 4, the first position is a position of the first roller when the first rotary shaft is positioned at an open end portion of the first slit.

7. The carrying apparatus according to claim 4, wherein the second position is a position of the first roller when the first rotary shaft is positioned at a closed end portion of the first slit.

8. The carrying apparatus according to claim 4, wherein the first moving mechanism further includes:

a guide member which supports the first rotary shaft such that the first roller is rotatable; and a first eccentric cam which is configured to rotate in a state in which a circumferential surface thereof is in contact with the guide member.

9. The carrying apparatus according to claim 1, further comprising:

a second roller which is provided on the other side of the opposite sides of the carry path and at a position different from that of the first roller in a conveying direction in which the first carried object and the second carried object are carried in the carry path;

a first gear which is provided coaxially with the second roller and is rotatable integrally with the second roller; and a second gear which is meshable with the first gear and provided on the one side of the carry path so as to be opposed to the first gear, wherein the drive source is configured to generate a drive force to rotate the second roller, and wherein the first pulley is provided coaxially with the second gear so as to be rotated integrally with the second gear.

10. The feed apparatus according to claim 1, wherein the fourth roller is located at a position where a straight line connecting between a center of the rotation of the first roller located at the second position and a center of the rotation of the fourth roller is perpendicular to the conveying direction.

11. The carrying apparatus according to claim 1, further comprising:

a fifth roller which is provided on the one side of the carry path and is located on the other side of the first roller from the first pulley in the conveying direction;

a third pulley which is provided coaxially with the fifth roller so as to be rotated integrally with the fifth roller;

a second belt which is wound on the second pulley at a position different, in an axis direction of the second pulley, from a position where the first belt is wound on the second pulley and which is wound on the third pulley so as to extend between the second pulley and the third pulley, the second belt being configured to be moved circumferentially between the second pulley and the third pulley;

a second tensioner which is fixed at a position where the second tensioner applies a predetermined tension to the second belt; and a second moving mechanism configured to move the fifth roller between a third position at which the fifth roller carries the first carried object and a fourth position which is farther from the carry path than the third position and at which the fifth roller carries the second carried object;

wherein the fourth position is a position at which a tension by the second tensioner to the second belt is substantially equal to the predetermined tension applied by the second tensioner to the second belt where the fifth roller is positioned at the third position; and wherein the first moving mechanism moves the first roller from the first position to the second position under a condition that the fifth roller starts to be moved from the third position to the fourth position by the second moving mechanism.

12. The carrying apparatus according to claim 11, further comprising a second rotary shaft which supports the fifth roller; and a pair of frames each of which is disposed at a corresponding one of opposite ends of the second rotary shaft, wherein each of the pair of frames has a second slit which guides the second rotary shaft so as to allow the fifth roller to move between the third position and the fourth position.

13. The carrying apparatus according to claim 12, wherein the second slit extends in a direction parallel to a direction from the third direction toward the fourth direction.

14. The carrying apparatus according to claim 12, wherein the fourth position is a position of the fifth roller when the second rotary shaft is positioned at a closed end portion of the second slit.

15. The carrying apparatus according to claim 11, wherein the first moving mechanism moves the first roller from the first position to the second position after the movement of the fifth roller from the third position to the fourth position by the second moving mechanism is completed.

16. The carrying apparatus according to claim 11, wherein an amount of the movement of the fifth roller from the third position to the fourth position is larger than that of the first roller from the first position to the second position, wherein the second moving mechanism capable of moving the fifth roller to a fifth position that is on a path of the movement of the fifth roller from the third position to the fourth position and that is distant from the fourth position toward the third position by a distance from the second position to the first position and in a direction from the second position to the first position, wherein the first moving mechanism moves the first roller from the first position to the second position under a condition that the movement of the fifth roller by the second moving mechanism from the third position to the fifth position is completed, and wherein the second moving mechanism moves the fifth roller from the fifth position to the fourth position at the same time as the first roller starts to be moved from the first position to the second position by the first moving mechanism.

17. The carrying apparatus according to claim 16, wherein a direction from the third position toward the fifth position is in parallel with a direction from the first position toward the second position.

18. An image recording apparatus including the carrying apparatus according to claim 1, wherein the carry path is defined to guide a recording medium as the first carried object and a tray as the second carried object on which the recording medium is placed, and wherein the image recording apparatus further comprises a recording portion which is provided so as to face a recording surface of the recording medium in the carry path and which is configured to record an image on the recording medium.

19. A carrying apparatus for carrying a first carried object and a second carried object which is larger in thickness than the first carried object, the carrying apparatus comprising:

a drive source;

a first pulley configured to be rotated by a drive force generated in the drive source;

a first roller;

a second pulley provided coaxially with the first roller and is configured to be rotated integrally with the first roller;

a belt which is wound on the first pulley and the second pulley;

a tensioner which is fixed at a position where the tensioner applies a predetermined tension to the belt;

a moving mechanism configured to move the first roller between (i) a first position at which the first roller carries the first object and (ii) a second position at which the first roller carries the second carried position;

a third roller configured to carry the first carried object, while nipping the first carried object with the first roller located at the first position; and a fourth roller configured to carry the second carried object, while nipping the second carried object with the first roller located at the second position.

20. The carrying apparatus according to claim 19, wherein the second position is a position at which a tension by the tensioner to the belt is substantially equal to the predetermined tension applied to the tensioner to the belt where the first roller is positioned at the first position.

* * * * *